US012728960B2

(12) United States Patent
Papadopoulos et al.

(10) Patent No.: US 12,728,960 B2
(45) Date of Patent: Sep. 8, 2026

(54) MOORING APPARATUS

(71) Applicants: Jeremy J Papadopoulos, Manchester (GB); Vincent Loccisano, Wellesley, MA (US)

(72) Inventors: Jeremy J Papadopoulos, Manchester (GB); Vincent Loccisano, Wellesley, MA (US)

( * ) Notice: Subject to any disclaimer, the term of this patent is extended or adjusted under 35 U.S.C. 154(b) by 393 days.

(21) Appl. No.: 18/489,206

(22) Filed: Oct. 18, 2023

(65) Prior Publication Data

US 2024/0124097 A1 Apr. 18, 2024

Related U.S. Application Data

(60) Provisional application No. 63/379,984, filed on Oct. 18, 2022.

(51) Int. Cl.

| | |
|---|---|
| ***B63B 21/50*** | (2006.01) |
| ***B63B 27/34*** | (2006.01) |
| ***B63B 35/44*** | (2006.01) |

(52) U.S. Cl.

CPC ..... *B63B 21/50* (2013.01); *B63B 27/34* (2013.01); *B63B 35/44* (2013.01); *B63B 2035/446* (2013.01)

(58) Field of Classification Search

CPC ..... B63B 21/50; B63B 27/34; B63B 35/44; B63B 2035/446

See application file for complete search history.

(56) References Cited

U.S. PATENT DOCUMENTS 8,692,401 B2 * 4/2014 Roddier ..... F03D 9/257 290/44
2010/0326667 A1 * 12/2010 Coppens ..... B63B 21/507 114/230.1

FOREIGN PATENT DOCUMENTS

EP 1308384 A2 * 5/2003 ..... B63B 27/34
WO WO-2006037964 A1 * 4/2006 ..... B63B 21/508

* cited by examiner

*Primary Examiner* — Stephen P Avila
(74) *Attorney, Agent, or Firm* — Keeley DeAngelo LLP; W Scott Keeley

(57) ABSTRACT

A mooring line on a second turbine has a hitch point with a mechanical connection to moor the turbine, and an energy conduit connection for transferring energy. The hitch point on the second turbine is adapted to align to a hitch point on a first turbine and to transfer both mechanical and energy conduit connections from the second turbine to the first turbine, releasing the second turbine. In this manner, the second turbine may be towed away for maintenance or repair, and the first turbine may remain to generate energy.

11 Claims, 7 Drawing Sheets

MOORING APPARATUS

TECHNICAL FIELD

The present disclosure relates in general to floating wind turbines and more specifically to mooring lines configured for switching moored turbines that have electrical or fluid connections along the mooring line.

BACKGROUND OF THE INVENTION

A wind turbine is a rotating machine that converts kinetic energy from wind into mechanical energy, which is converted to electricity. Utility-scale, horizontal-axis wind turbines have horizontal shafts that are commonly pointed into the wind by a shaft and generator assembly within a nacelle, at the top of a tower that is yawed relative to the tower in order to align the rotor with the wind. The nacelle commonly houses a direct drive generator or a transmission-and-generator combination.

Wind turbines used for offshore applications include single-tower systems mounted to the sea bed. Some float, using shallow submersible or semi-submersible platforms employing spars or spar buoys, tension legs, or a large-area barge-type construction. Offshore turbines are usually connected to a local power grid. Produced electrical energy is transferred and conditioned by grid systems.

Spars are ballasted, elongate structures that float at the water line, placing the center of gravity lower than the center of buoyancy. A spar is moored to the sea floor. Tension-leg platforms are permanently moored by tethers or tendons grouped at each of the structure's corners. A group of tethers is referred to as a tension leg. The design provides relatively high axial stiffness such that virtually all vertical motion of the platform is eliminated.

A large-area barge or "buoyancy-stabilized platform" is a heavy floating structure, moored to the sea bed, supporting a vertical axis turbine. Jack-up barges, similar to oil and gas platforms, are used as a base for servicing other structures such as offshore wind turbines. The state of the art emphasizes platforms that are immobilized against wave disturbance by mass, mooring, ballast and the like.

Many offshore wind fields are up to 100 miles from shore, with turbines that are not intended to be moved. For ballast and stability, heavy floating structures tend to be deeply placed, ruling out high-speed towing to shallow waters for maintenance. On-site, offshore installation, maintenance and repair are far more expensive and time-consuming than similar tasks conducted on land or in a near-land facility.

SUMMARY OF THE INVENTION

The present disclosure relates to a new class of shallow-draft offshore turbines resting on widely spaced floats which are engineered to tolerate wave motions, obviating the need for a massive base or complex mooring. The cheaper, lighter and shallower structure, commonly moored by one line, is also well-suited for towing, allowing maintenance to be performed ashore. A single-line mooring can be much faster to disconnect and reconnect. The present disclosure relates to a floating turbine that may be swapped for maintenance or repair by towing a working turbine adjacent to a non-working turbine; swapping the mooring line and energy conduit; and then towing away the non-working turbine. One skilled in the art understands that hardware that enables rapid swapping is also useful when installing a turbine by connecting it to pre-installed mooring and energy conduits.

One skilled in the art further understands that a turbine may generate electricity that may be transferred along an energy conduit and that a turbine may also use the generated electricity to power an electrolyzer to generate a working gas which in turn is transferred along an energy conduit. The term energy conduit refers to a means of transferring energy, electrical energy may be transferred along electrical power cables in a conduit, working fluid may be transferred along a fluid transfer conduit.

An apparatus for switching mechanical and energy conduit connections from one turbine to another enables a turbine to be exchanged with one requiring maintenance or repair. A tugboat may be adapted to tow the turbine to be swapped with a moored turbine. A mooring line on a first functioning turbine has a hitch point with a mechanical connection to moor the turbine, and an energy conduit connection for transferring energy from the turbine for distribution or storage. The hitch point on the first turbine is adapted to align precisely with a hitch point on a second, non-functioning turbine, and to transfer both mechanical and energy conduit connections from the second turbine to the first, releasing the second turbine. This enables the second turbine to be towed away for maintenance or repair, and the first turbine to remain to generate energy. In some embodiments, a mooring line is coupled with a rotary joint to mitigate line twisting while maneuvering mechanical and energy conduit joints, and also to tolerate changes in wind direction that slowly push a floating turbine around a circle. One skilled in the art is familiar with rotary joints used for the mitigation of cable twisting.

When a first turbine is towed proximal to a second turbine for swapping, the turbines are closely connected to enable mooring line and energy conduit to be transferred precisely and reliably from the second to the first turbine. Compliance checks are performed to avoid potentially damaging wave impacts on adjacent turbines. Connection-point standoffs, normally held at a fixed height by a cable or other connection from the connection point to the turbine hub, are allowed to move vertically relative to the turbine by slackening the cable. The buoyant connection point floats at the water surface, matching the local water elevation, even as the turbine lifts or tilts from waves interacting with its floats. The incoming first turbine is grappled to the second turbine in a sequence of steps designed for convenience, speed, and safety.

An example method for replacing a first damaged turbine with a second intact turbine includes the steps of:

- Connecting the second turbine to a boat
- Towing the second turbine next to the first turbine
- Disconnecting the energy conduit connection between the first turbine and the grid connection
- Placing a mooring-point upper body of the first turbine next a mooring-point upper body of the second turbine and aligning the two
- Sliding the first upper body and the second upper body along a keyed joint between the upper bodies and the mooring-line lower body
- Disconnecting the first turbine upper body from the lower body while connecting the second turbine upper body to the lower body, thereby releasing the first turbine
- Connecting the energy conduit on the second turbine One skilled in the art understands that the second turbine will then produce power to be transferred to the grid connection, and the first turbine may be towed to a near-shore facility for maintenance and repair.

DETAILED DESCRIPTION

Figure 1:
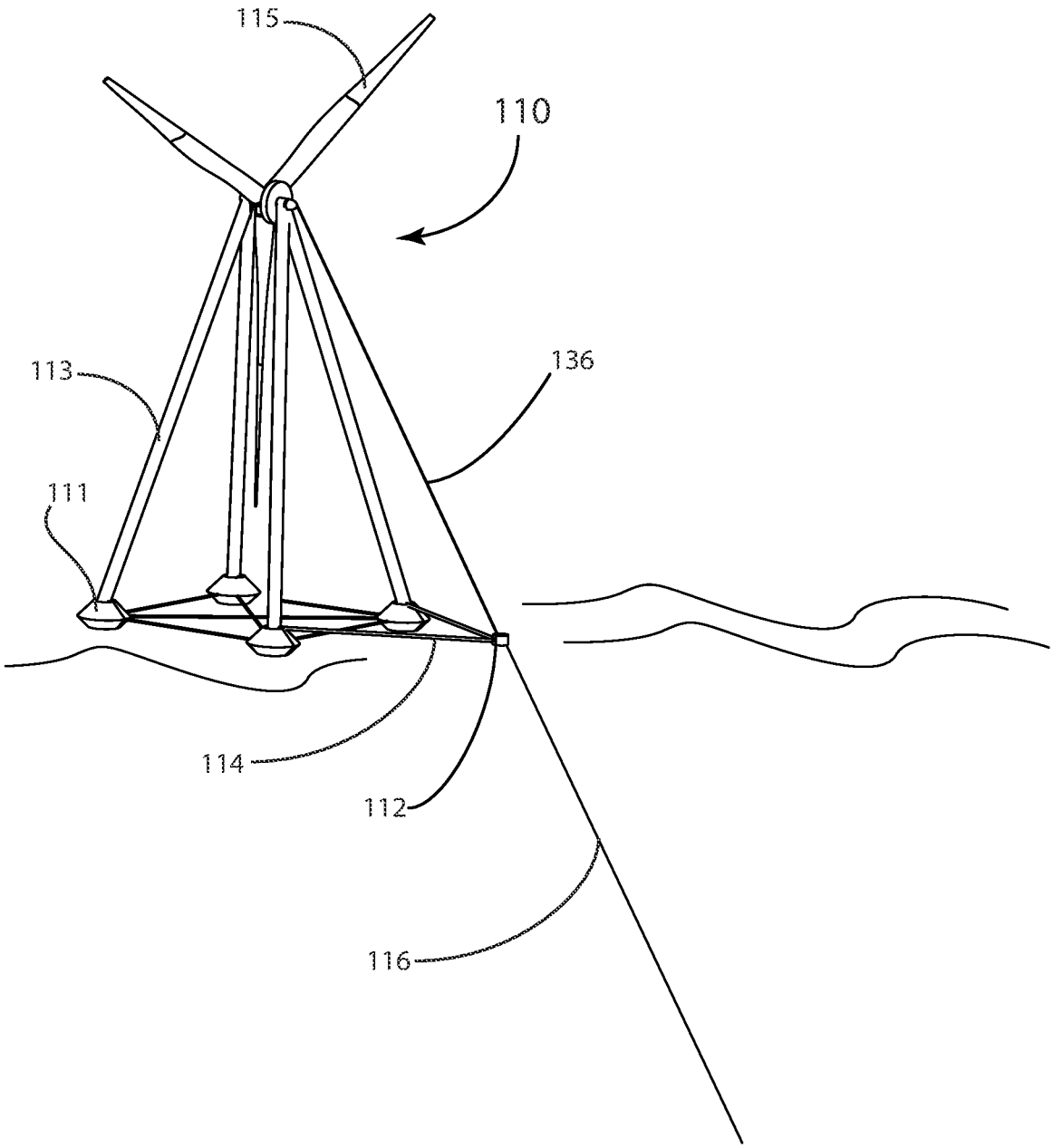
FIG. 1 is a perspective view of an example floating, moored second turbine of the present disclosure.

FIG. 1 shows a perspective view of an example embodiment 110. A wind-turbine tower 113 is supported by shallow floats 111. In the example embodiment the floats 111 are arranged in a rectilinear pattern. One skilled in the art understands that fewer or more than four shallow floats 111 could support a structure 113. In some embodiments, the overall structure includes four shallow floats 111 placed in a rectilinear pattern, further joined to a pyramidal structure that supports a wind-turbine rotor 115. Mooring standoffs 114 are connected to a tension member 136 and a hitch point 112, which is in turn attached to a mooring line 116. One skilled in the art understands that energy generated by the wind turbine 110 may be transmitted along a transmission conduit coupled with the mooring line 116.

Figure 2:
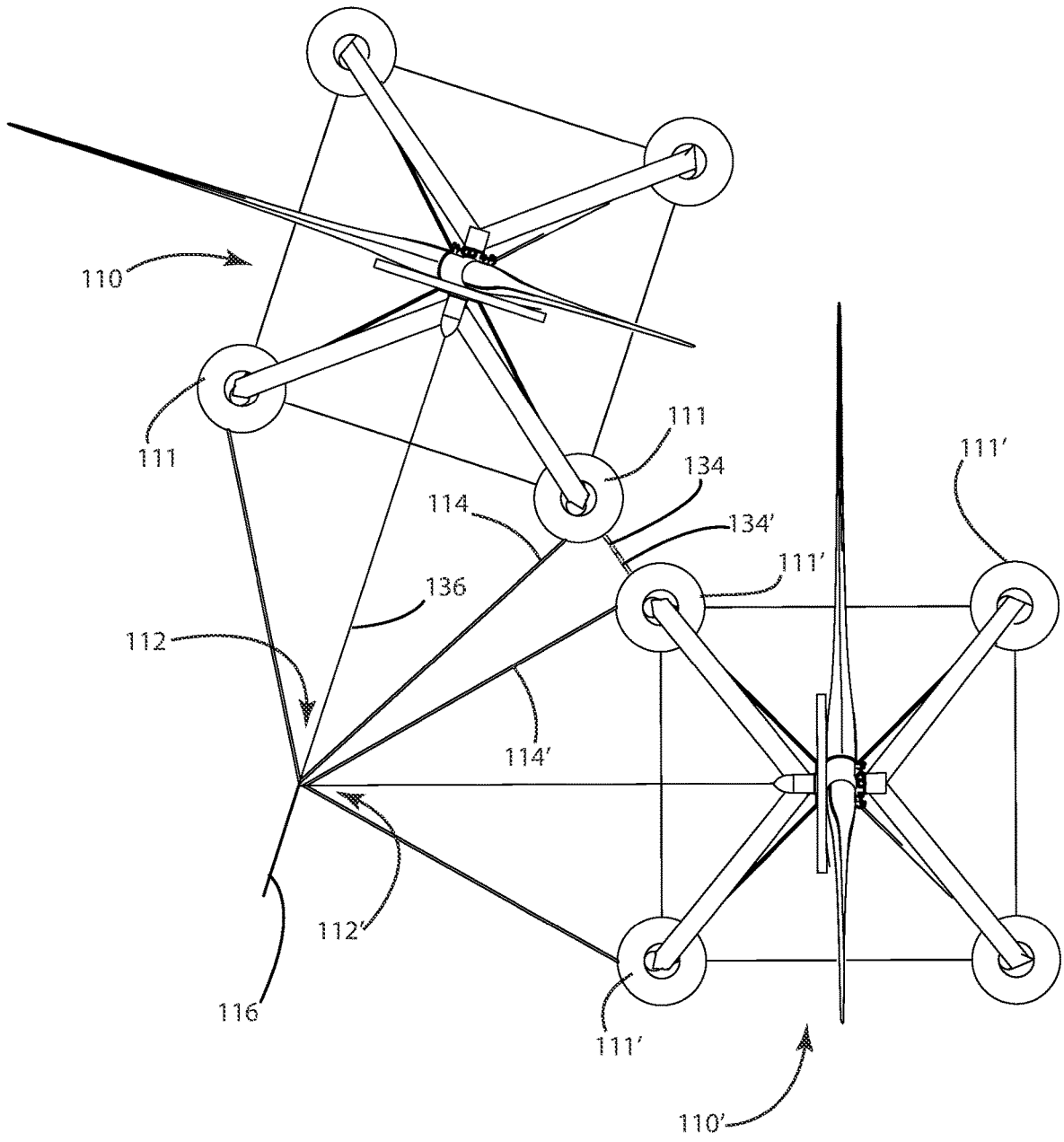
FIG. 2 is a top view of a working first turbine in the process of being swapped with a damaged second turbine.

FIG. 2 depicts two turbines 110 and 110' in the process of swapping. A hitch point 112 on turbine 110 is drawn close to a hitch point on another turbine 112'. Hitch points 112 and 112' are affixed to structural components 114 and 114' respectively. During the switching process, the turbines are connected and held at an appropriate space to avoid collision. In one embodiment, flexible connectors 134 and 134' are spacers. In some embodiments, flexible connectors 134 are affixed to floats 111 and 111'. The incoming turbine's float 111' is towed in grazing relation to the original turbine's float 111, so that compliant connection 134 can be joined to bind the floats together. After this, the connection/hitch point 112' is brought adjacent to connection/hitch point 112 by the towing vessel, so another compliant connection can be made and tightened. This places connection points 112 and 112' in precise relation to each other. In a preferred embodiment, mooring standoffs 114 and 114' are compliant or telescoping, so that waves tending to yaw or re-orient one turbine relative to the tugboat or to the other turbine will not cause large forces. Note that a towing vessel connected originally to 112' will move under wave action differently than the two large turbines, as allowed by the movability of connection points 112 and 112' in relation to their floating structures. The standoff compliance or telescoping prevents waves from causing stress and potential damage to the turbines or to the boat.

Figure 3:
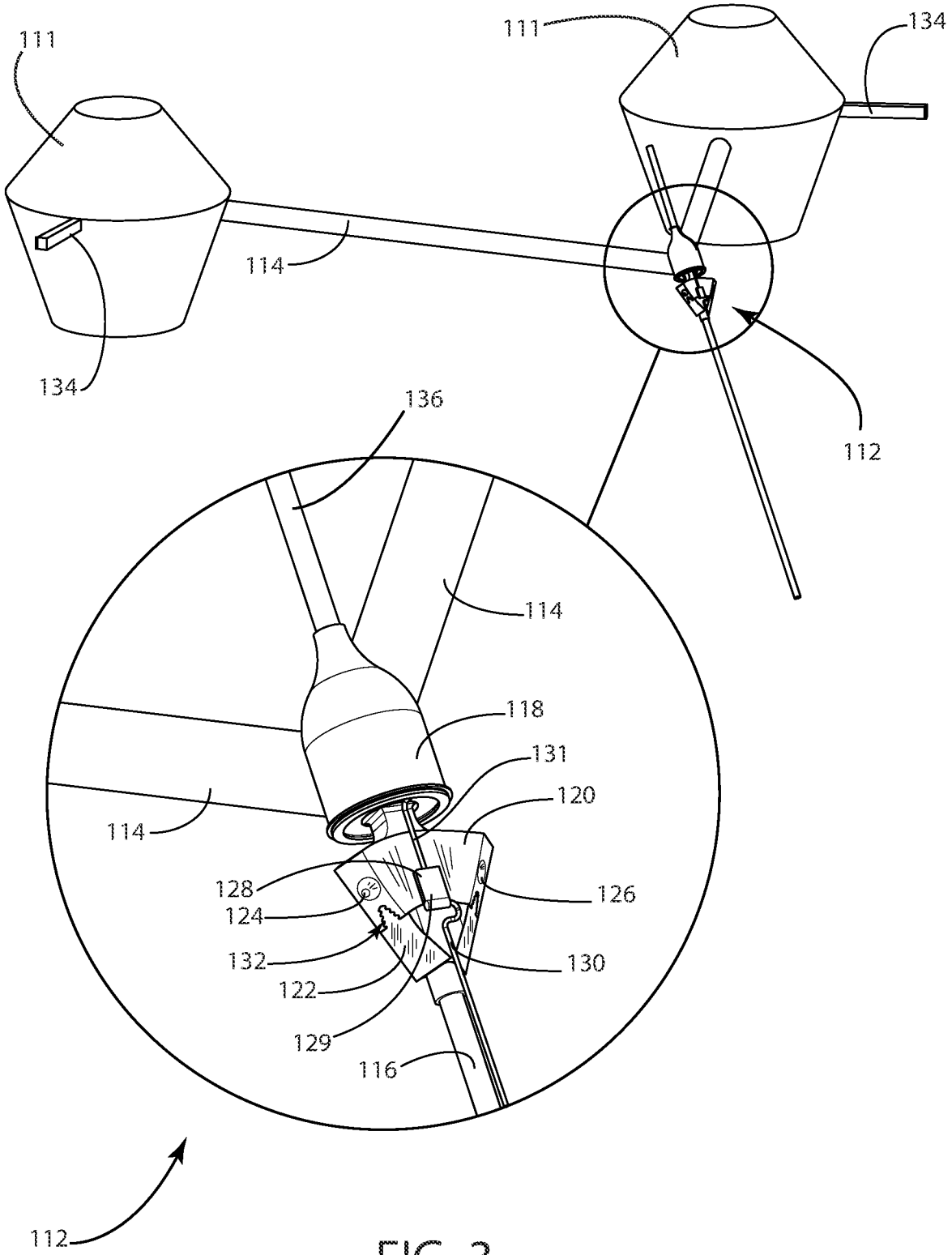
FIG. 3 is a detail, perspective view of a mooring line on a damaged second wind turbine with a mechanical, energy conduit switching connection, prior to a swapping process.

FIG. 3 shows a mooring hitch point 112 with a mechanical and energy conduit switching apparatus. Floats 111 are connected to flexible connectors 134. A rotary joint 118 connected to tension member 136 is a structural component of the turbine and is connected to a mechanical and energy conduit switching apparatus upper body 120 that has a protrusion 124 on a first side and a recess 126 on a second side. A keyed joint 132 joins the upper body 120 to a lower body 122 affixed to the mooring line 116. A stationary connector 128 connects to a movably movable connector 129 to join upper energy conduit 131 to lower energy conduit 130. In some embodiments, the lower energy conduit 130 is tethered to mooring line 116.

Figure 4:
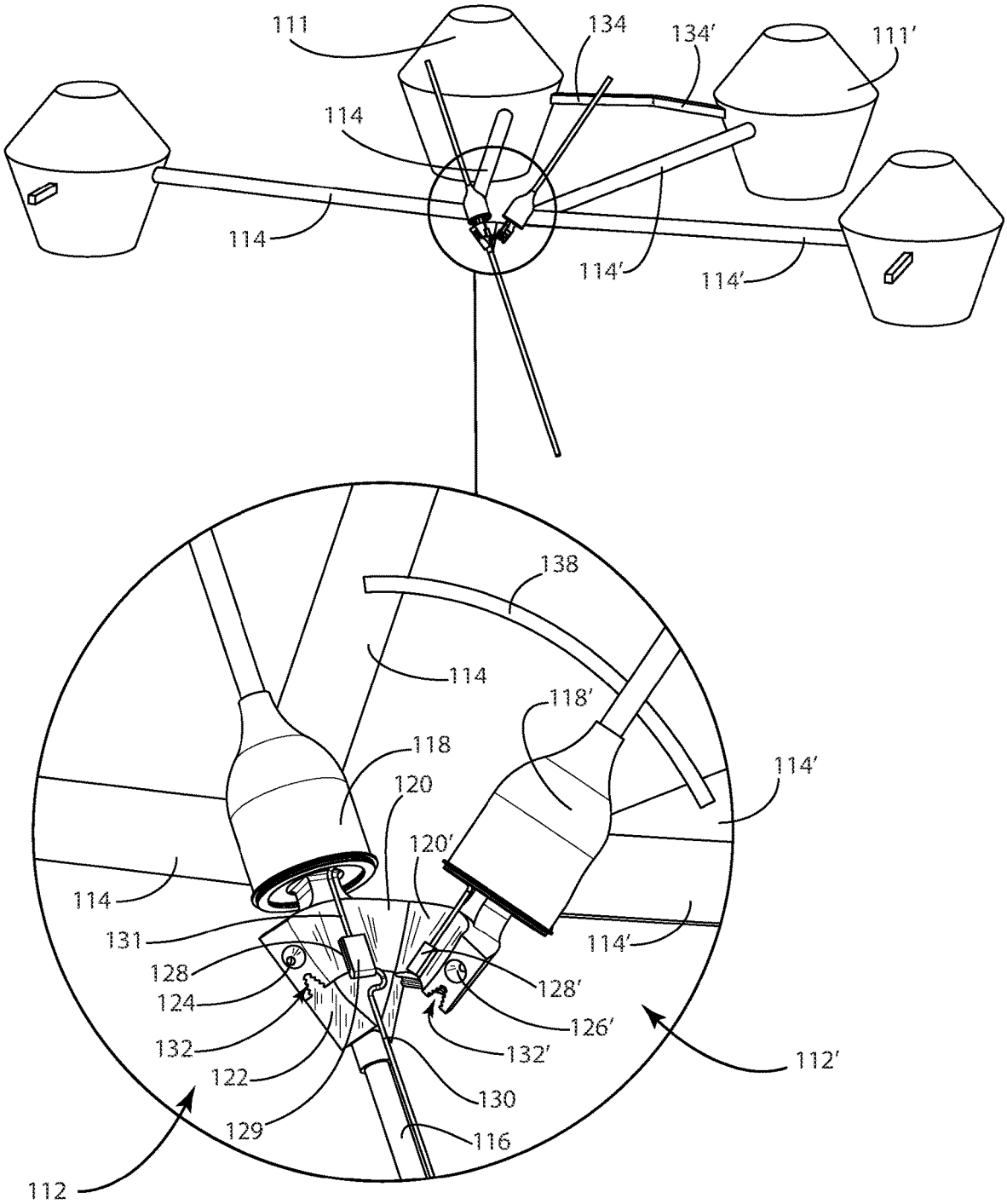
FIG. 4 is a detail, perspective view of a pair of turbines and a single mooring line with mechanical, energy conduit switching connections at the start of the line-switching process from the damaged second turbine to the working first turbine

FIG. 4 shows a mooring hitch point 112 with mechanical and energy conduit switching apparatus joined with a second mooring hitch point 112' for switching mechanical and energy conduit components. Structural components 114 and 114' are connected to flexible connectors 134 and 134' respectively. An additional connector 138 may flexibly draw structural components 114 and 114' together while switching occurs. Rotary joints 118 and 118' are structural components of the turbine carrying mechanical and energy conduit switching apparatuses to upper bodies 120 and 120'. One skilled in the art understands that 120' is substantially similar to 120 and that 120' may have a protrusion similar to that of 120 though it is not visible in this view. Co-located recesses 126 (FIG. 3) and 126' (FIG. 4) are on a second side. One skilled in the art understands that a protrusion 124' (FIG. 7) may mate with recess 126 to align upper body 120 with upper body 120'. Keyed joints 132 and 132' join the upper body 120 to a lower body 122 and allow lower body 122 to slide along the curved keyway to keyed joint 132'. The lower body 122 is affixed to the mooring line 116 and once transferred to upper body 120' will join mooring line 116 with hitch point 112' (FIG. 3). A stationary energy conduit connector 128' is affixed to upper body 120'. One skilled in the art is familiar with means for applying force to a lower body 122 to slide it along the curved keyway to keyed joint 132'.

Figure 5:
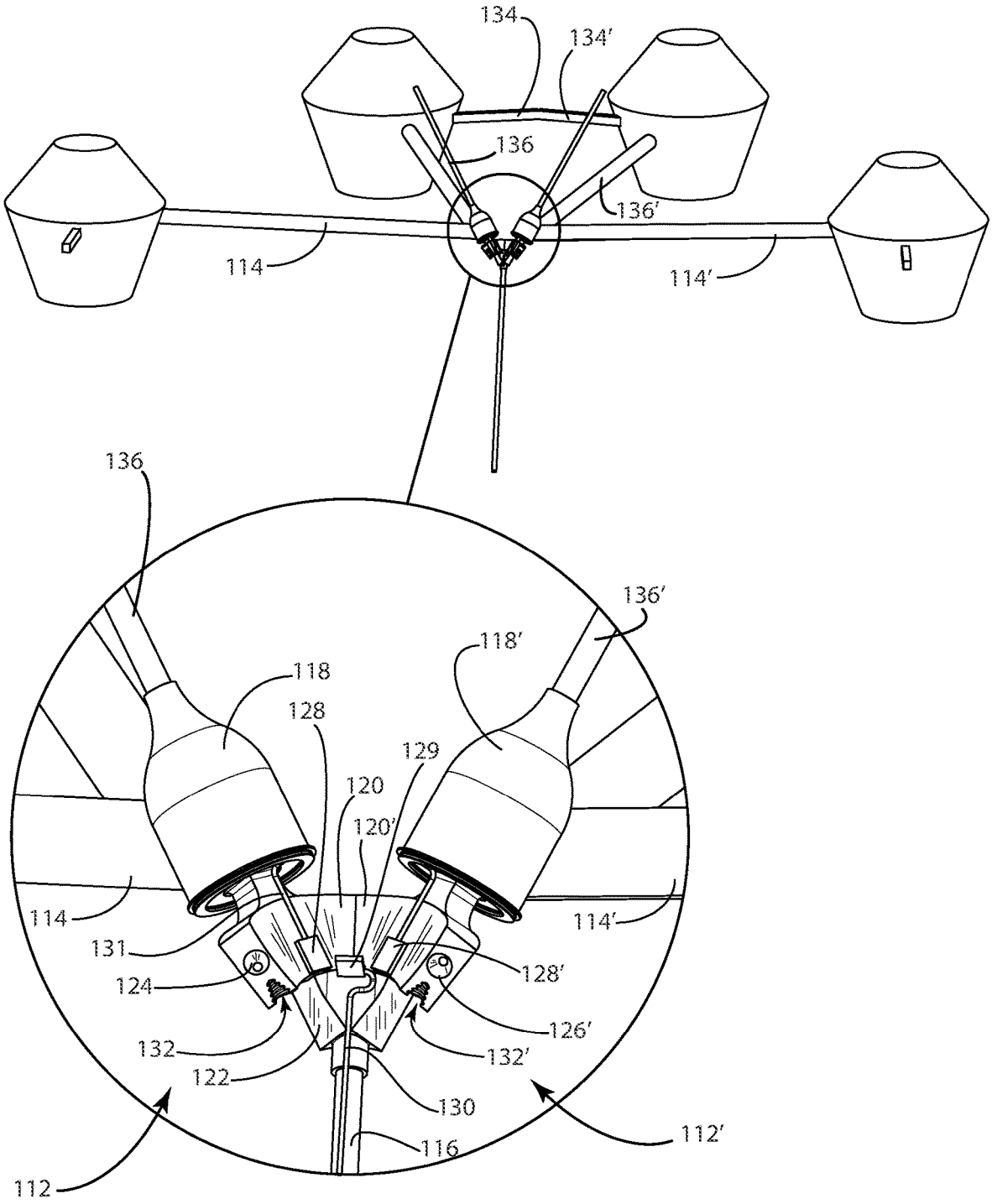
FIG. 5 is a detail, perspective view of a pair of floating turbines with mechanical, energy conduit switching connections during the line-switching process.

In FIG. 5, like reference numbers refer to like components previously described. A movably movable energy conduit connector 129 has been disengaged from stationary energy conduit connector 128 while the lower body 122 has been partially moved along keyways 132 and 132', relocating the lower body midway between upper bodies 120 and 120'.

Figure 6:
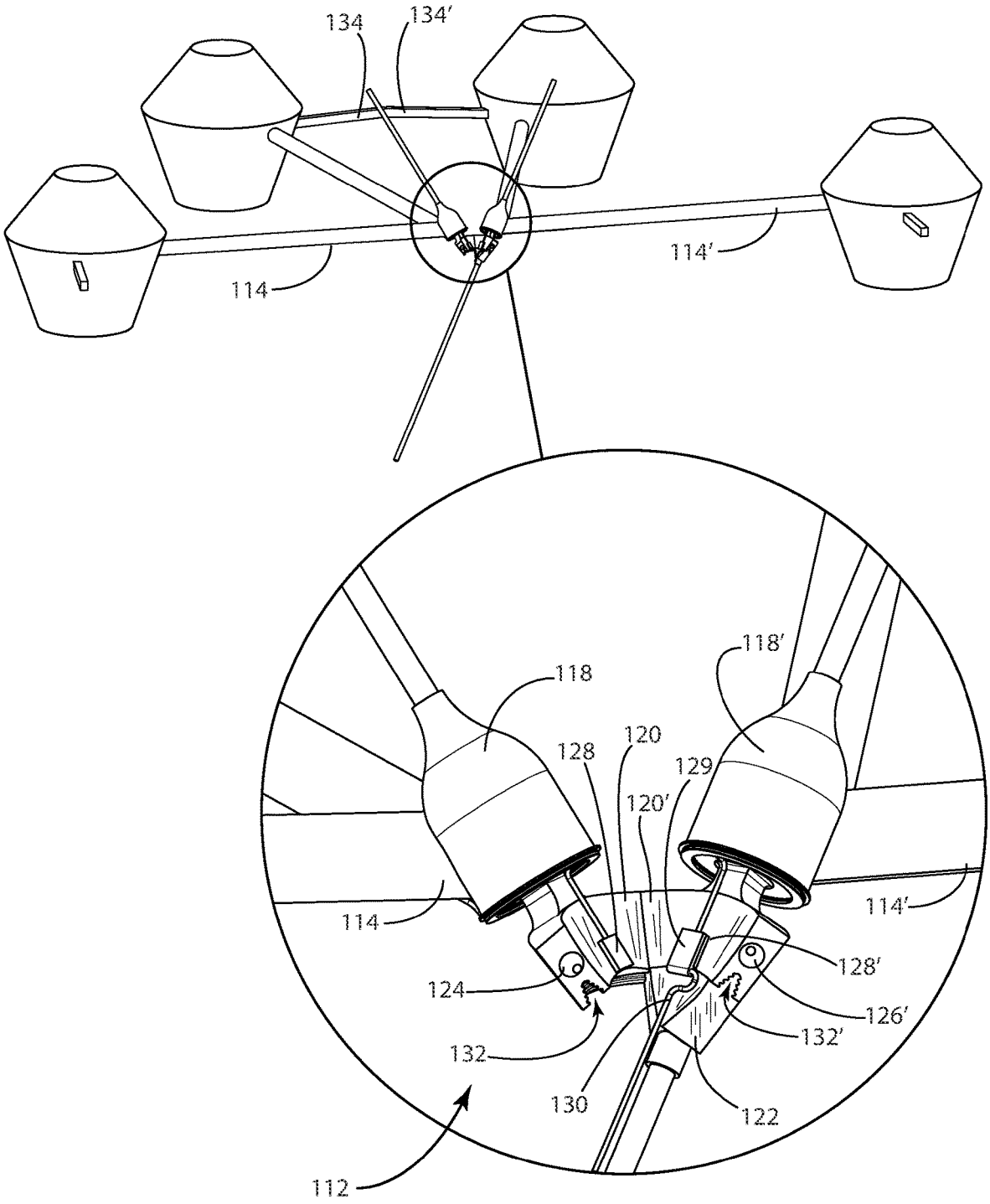
FIG. 6 is a detail, perspective view of a pair of floating turbines with mechanical, energy conduit switching connections, swapping the end of the line-switching process to the working first turbine.

In FIG. 6, like reference numbers refer to like components previously described. Lower body 122 has been moved along keyway 132' where it is affixed to upper body 120'. The movably energy conduit connector 129 has been engaged with stationary energy conduit connector 128'. Energy conduit and mechanical connections have been switched between hitch point 112 and hitch point 112' (FIG. 2), meaning that turbine 110' (FIG. 2) is now properly moored and can transfer energy along energy conduit 130 (FIG. 6). The pressure of the wind will move it into alignment, to the location previously occupied by the first turbine 110 (FIG. 2).

Figure 7:
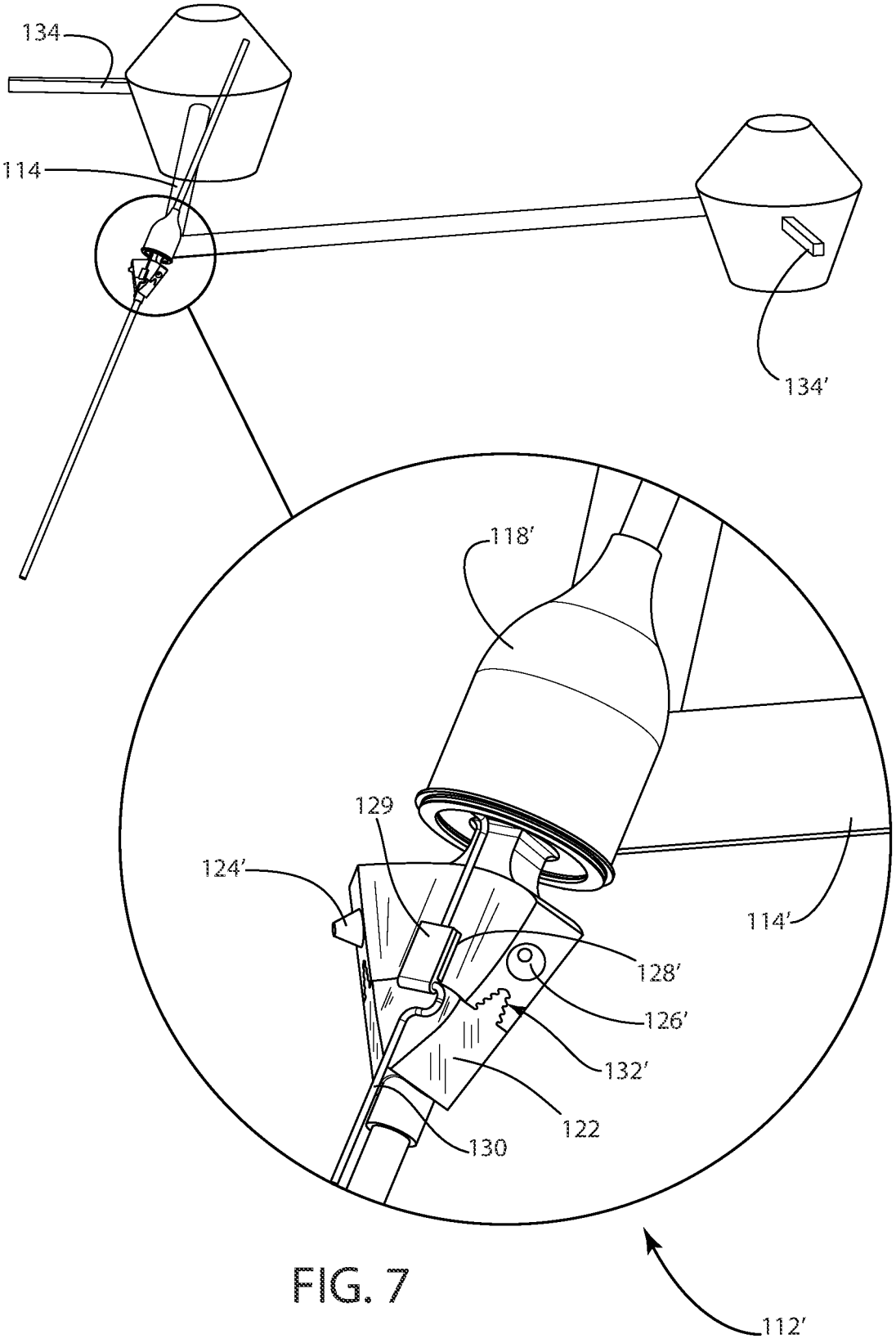
FIG. 7 is a detail, perspective view of a working first turbine with a mechanical, energy conduit switching connection as seen after the swapping process.

In FIG. 7, like reference numbers refer to like components previously described. Here, energy conduit and mechanical connections are fully engaged with hitch point 112' while hitch point 112 (FIG. 2) and its related turbine have been removed.

The invention claimed is:

1. An apparatus for transferring mechanical and energy conduit connections in a mooring from a first vessel to a second vessel comprising:

a first upper body fixedly engaged with a first vessel and slidably engaged with a lower body, which is in turn engaged with a mooring; and a protrusion on a first side of said first upper body and said second upper body, and a mating recess on a second side of said first upper body and said second upper body; and a fixed energy conduit coupling engaged with a movable energy conduit coupling; and a first energy conduit extending from said first vessel to said fixed energy conduit coupling; and a second energy conduit extending from said movable energy conduit coupling to said mooring; wherein a second upper body fixedly engaged with a second vessel slidably engages with said lower body to transfer said mechanical connection from said first upper body to said second upper body; said protrusion from said first upper body mates with said recess in said second upper body when the first upper body and second upper body are engaged side by side; and said fixed energy conduit coupling disengages from said movable energy conduit coupling to engage with a second vessel movable energy conduit coupling to transfer an energy conduit connection from said first vessel to said second vessel to release said first vessel from said energy conduit connection and said mooring.

2. The apparatus of claim 1 wherein:

said energy conduit is an electrical cable.

3. The apparatus of claim 1 wherein:

said energy conduit is a fluid transfer pipe.

4. The apparatus of claim 1 wherein:

said first vessel and said second vessel are each a floating wind turbine.

5. The apparatus of claim 1 further comprising:

a keyed pathway along which said first upper body and said second upper body are slidably engaged with said lower body.

6. The apparatus of claim 1 further comprising:

a rotating joint having a fixed end fixedly engaged with said vessel, and a rotating end rotatably engaged with a mooring line; and an energy conduit coupling through both said fixed end and said rotating end; wherein said rotating joint isolates twisting motion between said mooring line and said vessel while allowing energy to flow through said energy conduit that passes through said rotating joint.

7. The apparatus of claim 1 further comprising:

a first flexible connector fixedly engaged with said first vessel; and a second flexible connector fixedly engaged with said second vessel; and said first flexible connector and said second flexible connector are releasably engaged; wherein said first vessel and said second vessel are held in close proximity while mechanical and energy conduit connections are transferred between said first upper body and said second upper body.

8. The apparatus of claim 7 further comprising:

a third flexible connector fixedly engaged with said first vessel; and a fourth flexible connector fixedly engaged with said second vessel; and said third flexible connector and said fourth flexible connector are releasably engaged; wherein said first vessel and said second vessel are held in close proximity while mechanical and energy conduit connections are transferred between said first upper body and said second upper body.

9. An apparatus for transferring mechanical and energy conduit connections from a moored floating wind turbine to a second floating wind turbine comprising:

a first floating wind turbine releasably engaged with a mooring, and a second floating wind turbine proximal to said first floating wind turbine, each floating wind turbine having electrical-generation equipment supported by a structure; and said structure including a mooring point; and a first energy conduit coupled with said energy-generation equipment and engaged with said structure; and said first energy conduit further engaged with a rotating joint; and said rotating joint having a fixed end fixedly engaged with said structure and a rotating end engaged with an upper mooring member, and a rotatable energy conduit coupling through said rotating joint further releasably engaged with a second energy conduit; and said upper mooring member slidably engaged with a lower mooring member; and said second energy conduit releasably engaged with said first energy conduit and engaged with said lower mooring member and said mooring; wherein said first wind turbine upper mooring member, engaged with said second wind turbine upper mooring member, are slidably engaged with said lower mooring member, and said second energy conduit is released from said first energy conduit on said first wind turbine upper mooring member and releasably engaged with said second floating wind turbine upper mooring member and said second floating wind turbine first energy conduit, to transfer said mechanical and energy conduit connections from said first floating wind turbine to said second floating wind turbine.

10. The apparatus of claim 9 further comprising:

at least one flexible connector releasably engaged between said first floating wind turbine and said second floating wind turbine; wherein said first floating wind turbine and said second floating wind turbine are flexibly coupled while said mechanical and energy conduit connections are transferred.

11. A method for transferring a mechanical and an energy conduit connection between a first moored floating wind turbine to a second floating wind turbine of claim 8, the method comprising:

connecting said second floating wind turbine to a boat;

towing said second floating wind turbine proximal to said first moored floating wind turbine; and disconnecting said first energy conduit from said second energy conduit; and locating said first upper mooring member on said first floating wind turbine proximal to said second upper mooring member on said second floating wind turbine; and slidably engaging said second upper mooring member with said lower mooring member; and disconnecting said first floating wind turbine from said mooring; and connecting said second floating wind turbine energy conduit to said second energy conduit; wherein mechanical and energy conduit connections from said first floating wind turbine are transferred to said second floating wind turbine.

* * * * *